US010467929B2

(12) United States Patent
Notarkesh

(10) Patent No.: US 10,467,929 B2
(45) Date of Patent: Nov. 5, 2019

(54) RETRACTABLE WARNING SIGN

(71) Applicant: Hossein Notarkesh, North Bay (CA)

(72) Inventor: Hossein Notarkesh, North Bay (CA)

( * ) Notice: Subject to any disclaimer, the term of this patent is extended or adjusted under 35 U.S.C. 154(b) by 0 days.

(21) Appl. No.: 15/813,720

(22) Filed: Nov. 15, 2017

(65) Prior Publication Data

US 2019/0147777 A1 May 16, 2019

(51) Int. Cl.

| | |
|---|---|
| ***G09F 11/08*** | (2006.01) |
| ***G09F 7/22*** | (2006.01) |
| ***G09F 11/29*** | (2006.01) |
| *G09F 17/00* | (2006.01) |
| *G09F 7/18* | (2006.01) |

(52) U.S. Cl.

CPC ..... *G09F 7/22* (2013.01); *G09F 11/29* (2013.01); *G09F 2007/1856* (2013.01); *G09F 2007/1873* (2013.01); *G09F 2017/0041* (2013.01)

(58) Field of Classification Search

CPC .... G09F 7/22; G09F 11/29; G09F 2007/1856; G09F 2007/1873; G09F 2017/0041; G09F 11/02; G09F 11/08

USPC ..... 40/514–517

See application file for complete search history.

(56) References Cited

U.S. PATENT DOCUMENTS

| | | | | |
|---|---|---|---|---|
| 2,610,420 A * | 9/1952 | Kohl | A45B 3/00 116/173 |
| 3,996,882 A * | 12/1976 | Martin | G09F 17/00 116/174 |
| 4,332,210 A * | 6/1982 | Lambert | G09F 17/00 116/173 |
| 2006/0124796 A1* | 6/2006 | Morgan | G09F 11/08 242/390.8 |
| 2016/0284254 A1* | 9/2016 | Scaturro | G09F 17/00 |
| 2018/0047317 A1* | 2/2018 | Mahedy | G06F 3/04847 |

* cited by examiner

*Primary Examiner* — Cassandra Davis

(74) *Attorney, Agent, or Firm* — Nasser Ashgriz; UIPatent Inc.

(57) ABSTRACT

A retractable warning sign having a timer, comprising: an elongated housing having a longitudinal slot, a distal end, and a proximal end; a retractable strap wound around a spool assembly and housed inside said elongated housing that extends and retracts through said longitudinal slot; a timer connected to said spool assembly to set a retraction time for said retractable strap; a hinge assembly coupled to said proximal end of said elongated housing to provide a translational movement for said elongated housing, and an attachment mechanism to attach said elongated housing on a wall or a ceiling or a window.

6 Claims, 14 Drawing Sheets

RETRACTABLE WARNING SIGN

FIELD OF THE INVENTION

The present invention relates in general to warning signs and in specific to an automatic rolling sign with a timer.

BACKGROUND OF THE INVENTION

The warning signs are frequently used to alert pedestrians about dangerous or harmful conditions such as a wet or slippery floor. Wet surfaces are commonly marked by safety markers in restaurants, grocery stores, factories, shopping malls, hospitals and other areas where foot traffic is prevalent and spills may occur. Their purpose is generally to prevent people from coming into contact with the wet surface so as to prevent slips and falls due to the slippery surface caused by the wetness.

Floors that are wet, following a cleaning or due to a spill, pose a safety hazard for pedestrians. Such conditions may result in accidents and injuries, and give rise to law suits against the building owners and/or operators.

Typically, these warning signs include collapsible safety markers, which are foldable, plastic cones that are placed on designated areas, expendable sheet-like objects that are easy to hang, or caution tapes to protect people from entering the dangerous areas.

One of the major drawbacks of the warning signs is that they are not immediately removed once they are not needed. One example of unattended warning signs is the wet sign in hospitals, care homes and retirement homes. In many hospitals, the sings set on wet floors, remain in place for many hours after the floor is dried. This may cause issues in transportation of patients and the wheelchairs. In addition, if the signs are left for long time, they may even cause contamination in places like hospitals. Over 90% of the wet signs that are seen in public areas are on dry surfaces because typical wet floor dry within 30 to 60 minutes of displaying the sign. The attendant of the warning sign may not regularly check the sign, and very often, the sign remains in place until the next day.

Another issue with excessive use of warning signs is that it creates complicity towards its message and presence. Therefore, people may not pay enough attention to them after a while. They themselves may also become a trip hazard.

The present invention is designed to help eliminate difficulties associated with currently used warning signs.

SUMMARY OF THE INVENTION

The first embodiment of the present invention is a sign system, which rolls up and/or rolls in after a preset period of time. The sign system has a built-in mechanical timer. The timer can be adjusted to a set time (for example an hour) after which the sign will roll up automatically. This function is essential in places that the sign has to be removed, once it is not applicable. For example, a wet floor sign is lifted when the floor is dried, or a closed sign on a store is lifted after the store is opened.

The present warning sign is set to operate only until it is necessary. It is automatically removed once it is not needed, therefore, it is a safer sign. The present sign is automatically removed after a preset period of time. The sign can be mounted at strategic location to be used as needed. It can be attached to a door jam or a ceiling so that it is not a trip hazard when it is not in use and it will be visible when it is in use.

The first objective of the present invention is to provide a sign with a timer, which can be rolled in after a preset period of time.

The second objective of the present invention is to maximize the visibility and appearance of the sign when it is displayed, and that it is removed by itself to avoid any trip hazards and to become complacent.

The third objective of the present invention is to provide a more sanitary practice for signs, as the present system is not set on the floor (most of the wet signs are not clean) such as on the floors of public washrooms and hospitals.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modification and alteration, and that the disclosed technology be limited only by the claims and equivalents thereof.

DETAILED DESCRIPTION OF PREFERRED EMBODIMENTS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
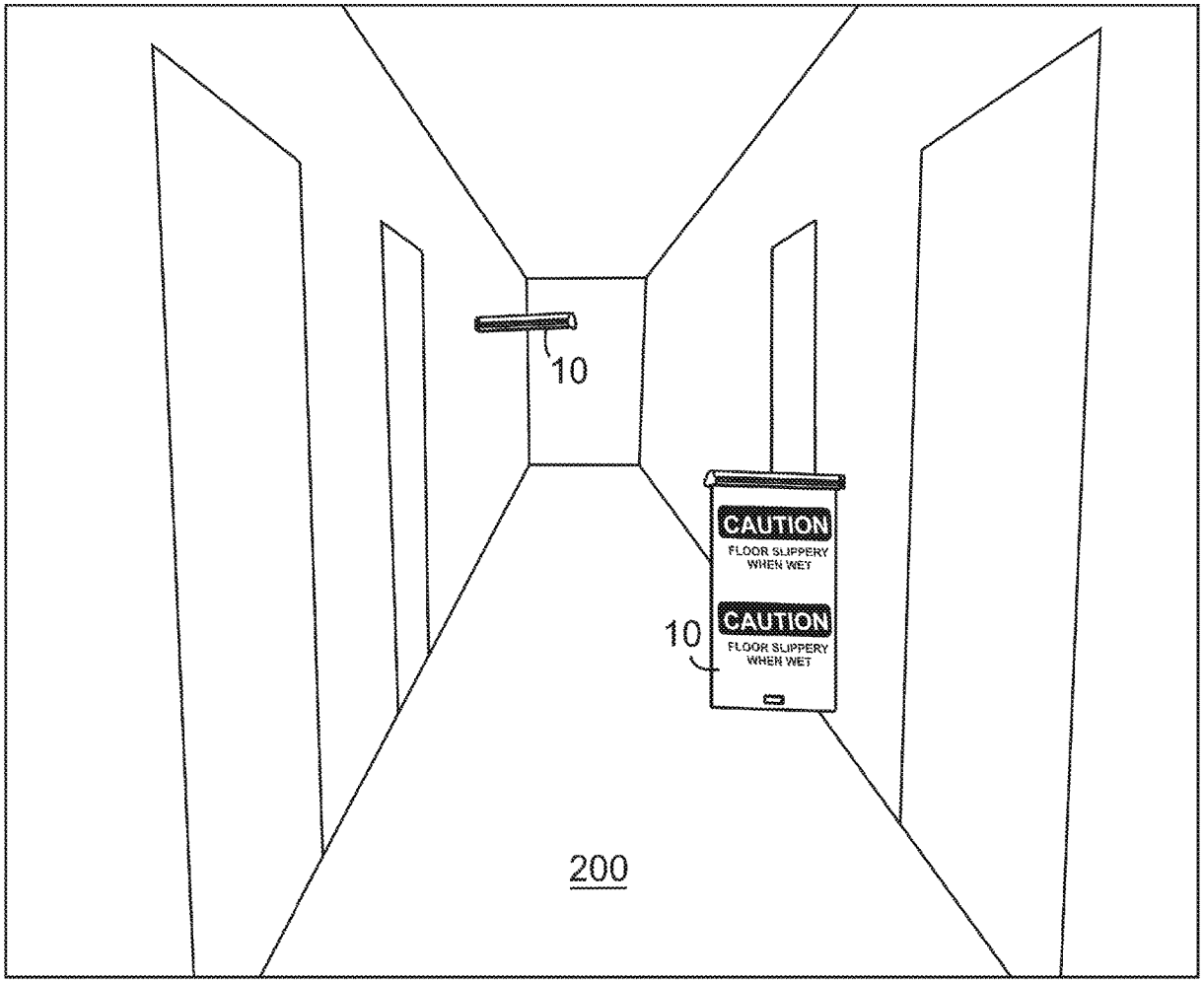
FIG. 1 shows a schematic view of the first embodiment of the present invention in a hallway.
Figure 2:
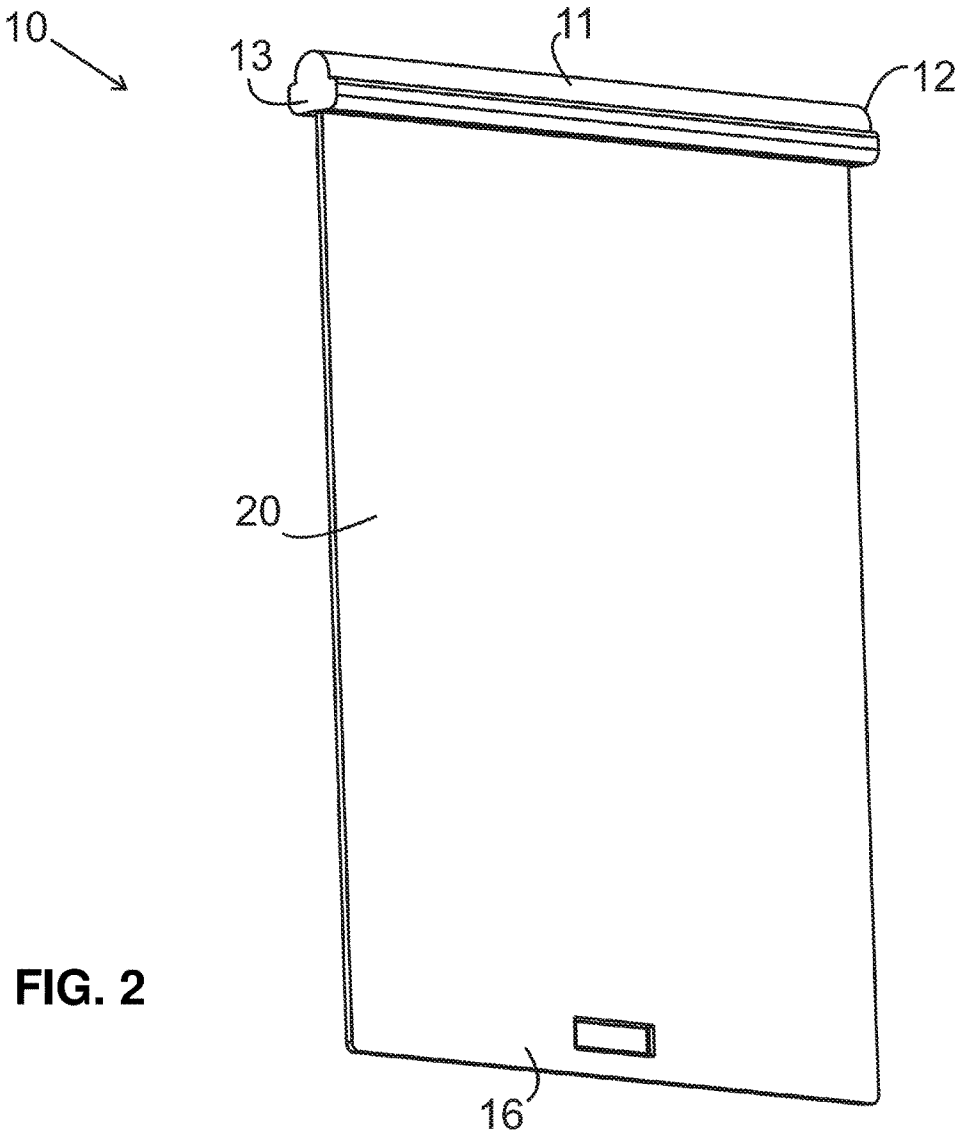
FIG. 2 shows a perspective view of the first embodiment of the present invention.
Figure 3:
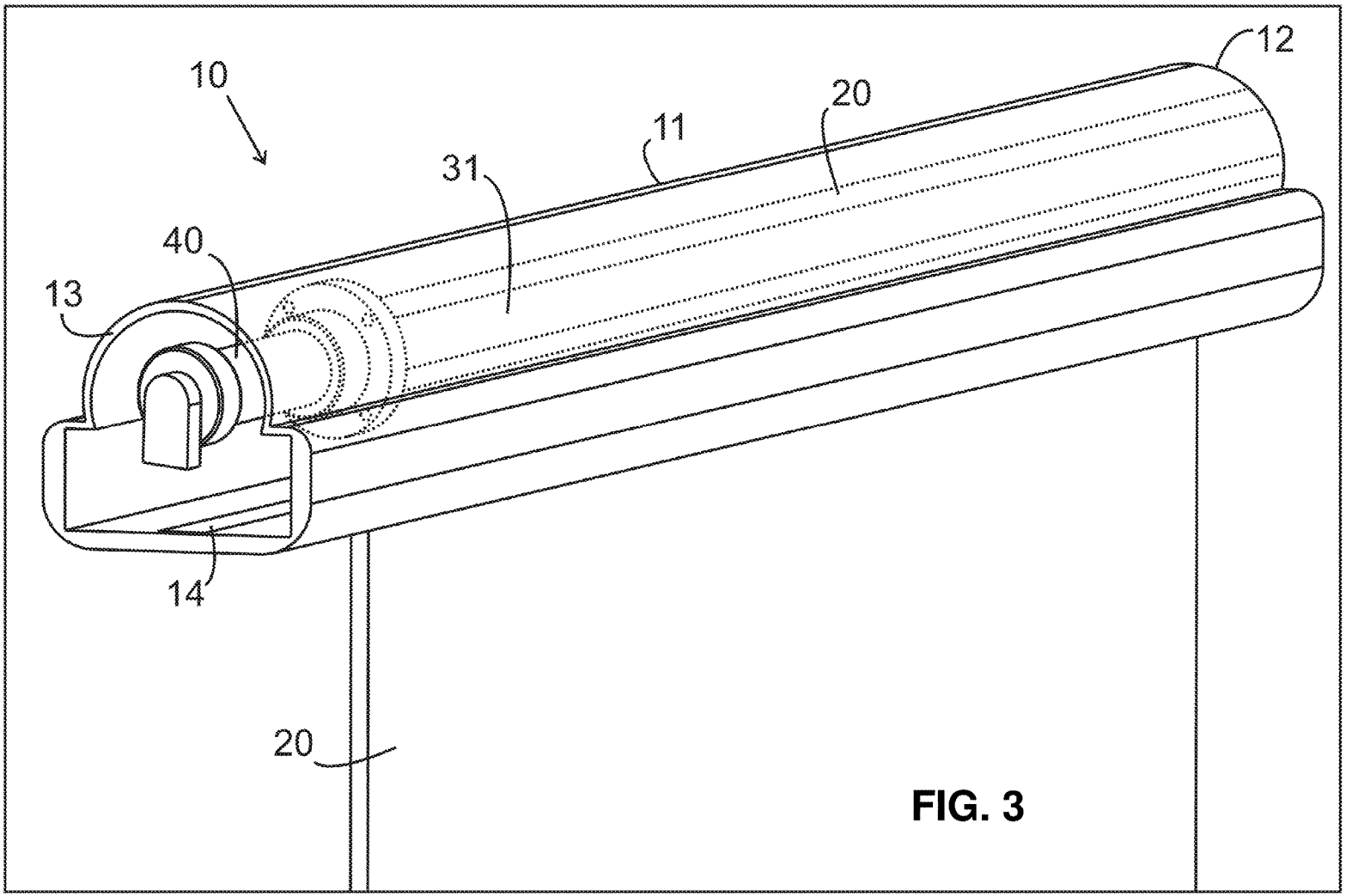
FIG. 3 shows an inside view of the housing for the first embodiment of the present invention.

FIG. 1 shows a wet sign 10 based on the first embodiment of the present invention. A person which is responsible for the cleaning of the hallway 200 pulls out the wet sign 10 which hangs on the hallway 200. The wet sign 10 has a built-in mechanical timer in the housing, which after a pre-set period of time (for example one hour) it will roll in inside the housing.

Again as shown in FIG. 1, there are two wet signs 10 which one of the sign is pulled out and sets for a pre-set period of time and the other one is pulled in after the pre-set period of time.

FIGS. 1-6 show the first embodiment of the present invention. The first embodiment of the present invention is a timer caution sign 10, which comprises of a housing 11, which has a distal end 12, a proximal end 13 and a slot 14 is formed in the housing 11 in a position such that an elongate strap 20 extends and retracts through the slot 14. The elongated strap 20 is housed inside the housing 11. The elongated strap 20 is extendable from the housing in a direction generally perpendicular to a longitudinal axis of the housing 11.

Figure 4:
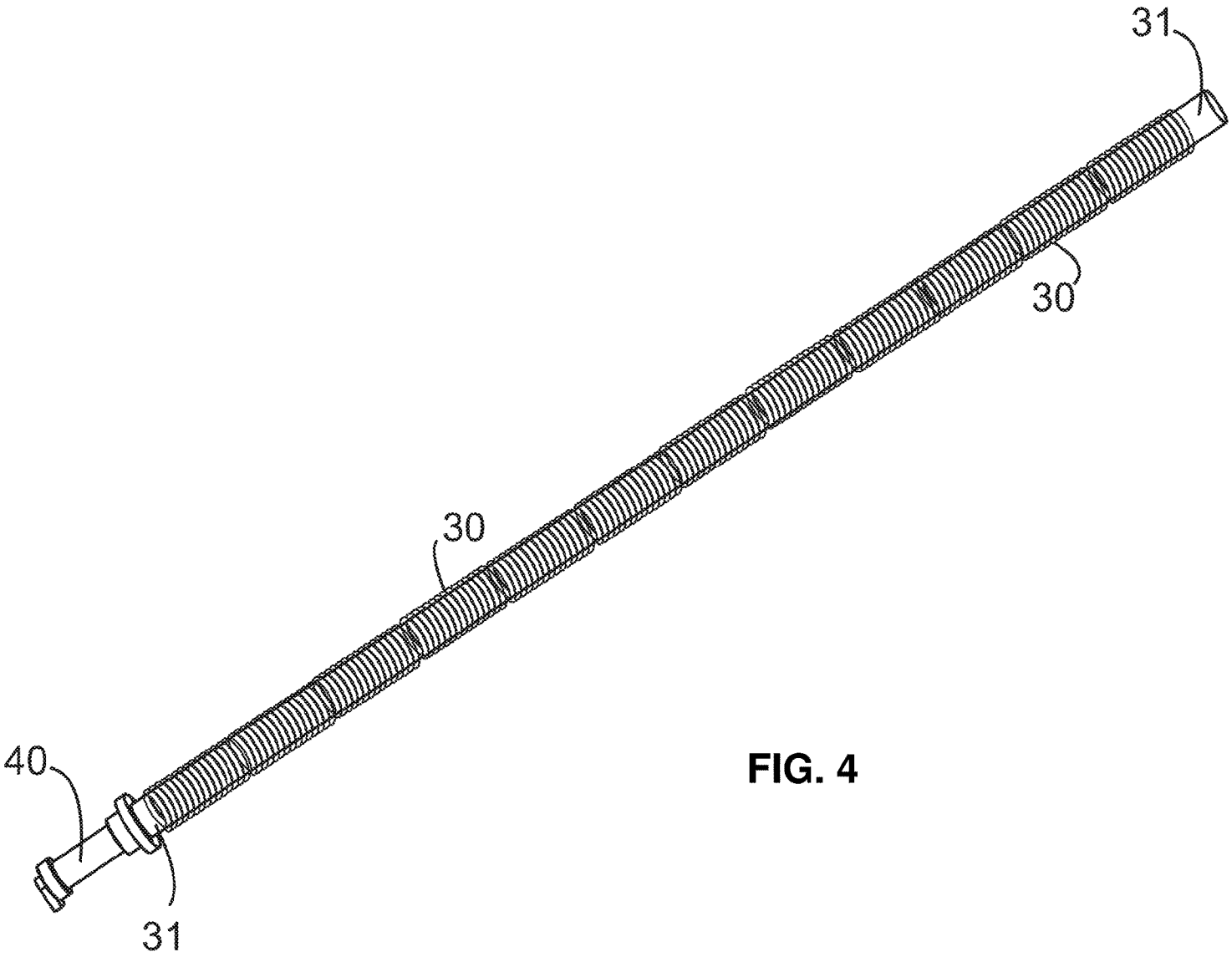
FIG. 4 shows a schematic view of the mechanical timer with the spool for the first embodiment of the present invention.
Figure 5:
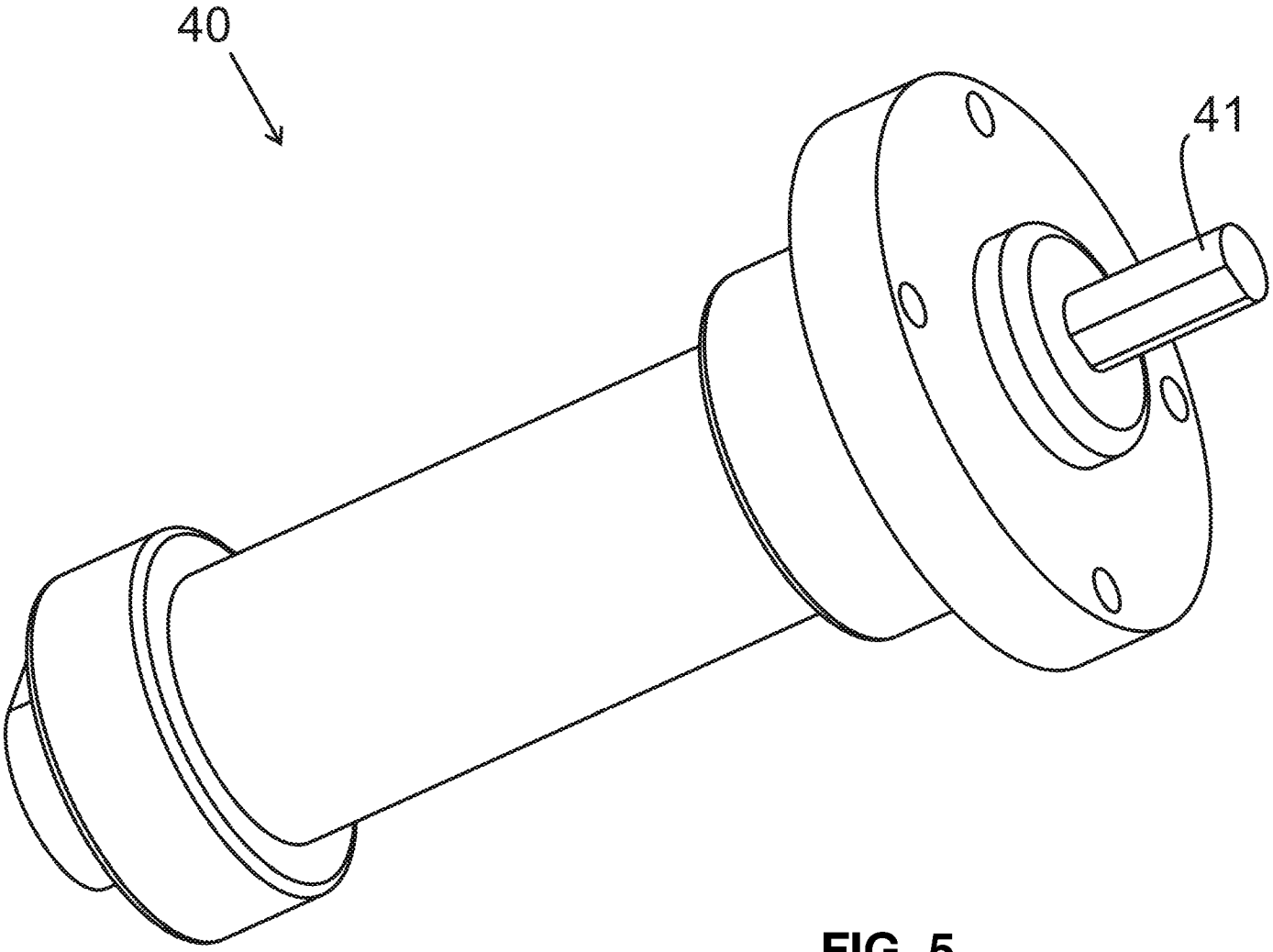
FIG. 5 shows a schematic view of the mechanical timer for the first embodiment of the present invention.
Figure 6:
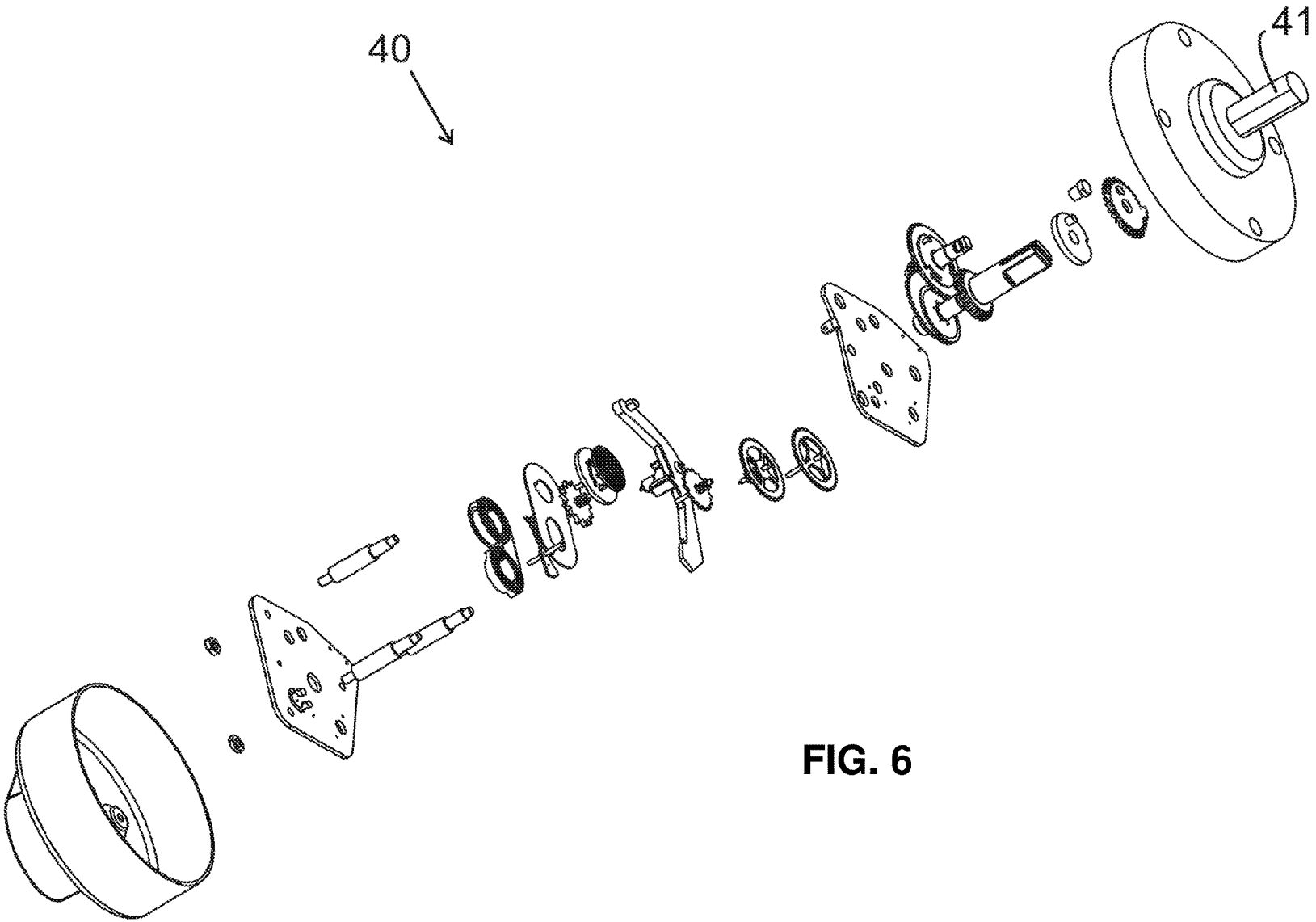
FIG. 6 shows an inside view of the mechanical timer for the first embodiment of the present invention.

As shown in FIG. 4, a spring assembly 30 around a spool 31 for maintaining tension on the elongated strap 20 is designed in the present invention while the strap 20 is in an extended position such that the strap 20 will retract into the housing 11 when a free end 16 of the strap 20 is not held. The spool 31 located within the housing 11 and the elongated strap 20 is wound on the spool 31.

Again as shown in FIGS. 3-6, a mechanical timer 40 connected to the spool 31 such that rotation of the spool 31 causes rotation of the mechanical timer 40. The mechanical timer 40 is designed in such a way that the elongated strap 20 retracts at a specific time after display. The mechanical timer 40 can be designed in such a way to trigger a releasing part 41 to release the spring assembly 30 to retract the elongated strap 20.

Based on the type of the caution sign, the mechanical timer 40 can be designed to trigger the releasing part 41 after a specific period of time. The mechanical timer 40 can be operated with a plurality of gears and springs to represent a specific time and trigger a realising point. For example, for the wet sign the mechanical timer can be set for one hour. After one hour, the caution sign retracts into the housing.

There are a number of different mechanical times, any of which can be incorporated in the present system. One method is based on the length of the elongated strap, which is pulled out from the housing. In this case, the time for releasing the strap inside the housing may vary. If half of the elongated strap is pulled out from the housing and the whole system is designed for a sign with one hour, then, after 30 minutes the straps returns into the housing.

Figure 7:
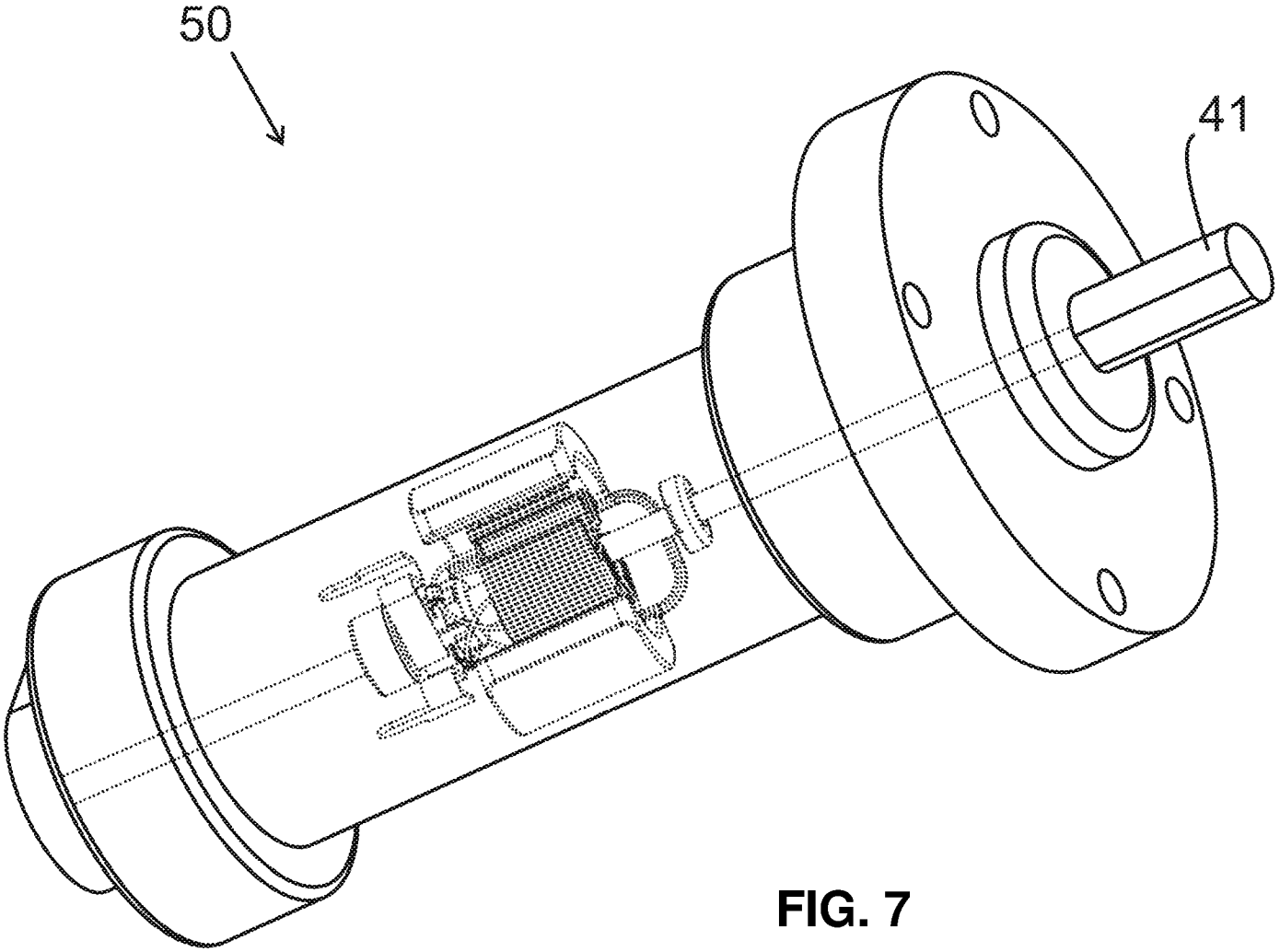
FIG. 7 shows an inside view of the electro-mechanical timer for the first embodiment of the present invention.

In a second embodiment of the present invention, the mechanical timer can be replaced by an electro-mechanical timer 50 as shown in FIG. 7. The electro-mechanical timer 50 can be programmed to trigger the releasing part 41 to retract the caution sign 20 into the housing 11. The electro-mechanical timer 50 further has a communication means such as Bluetooth or Wi-Fi to communicate with a mobile phone or a computer. The mobile phone or the computer can control the operation of the electro-mechanical timer 50.

The electro-mechanical timer 50 in the present invention can be a cam timer for controlling a sequence of events automatically. An electric motor in the cam timer drives a shaft on which a series of cams with pegs along its surface are arranged. Indentations or protrusions on the cams operate the switches at different times.

Figure 8:
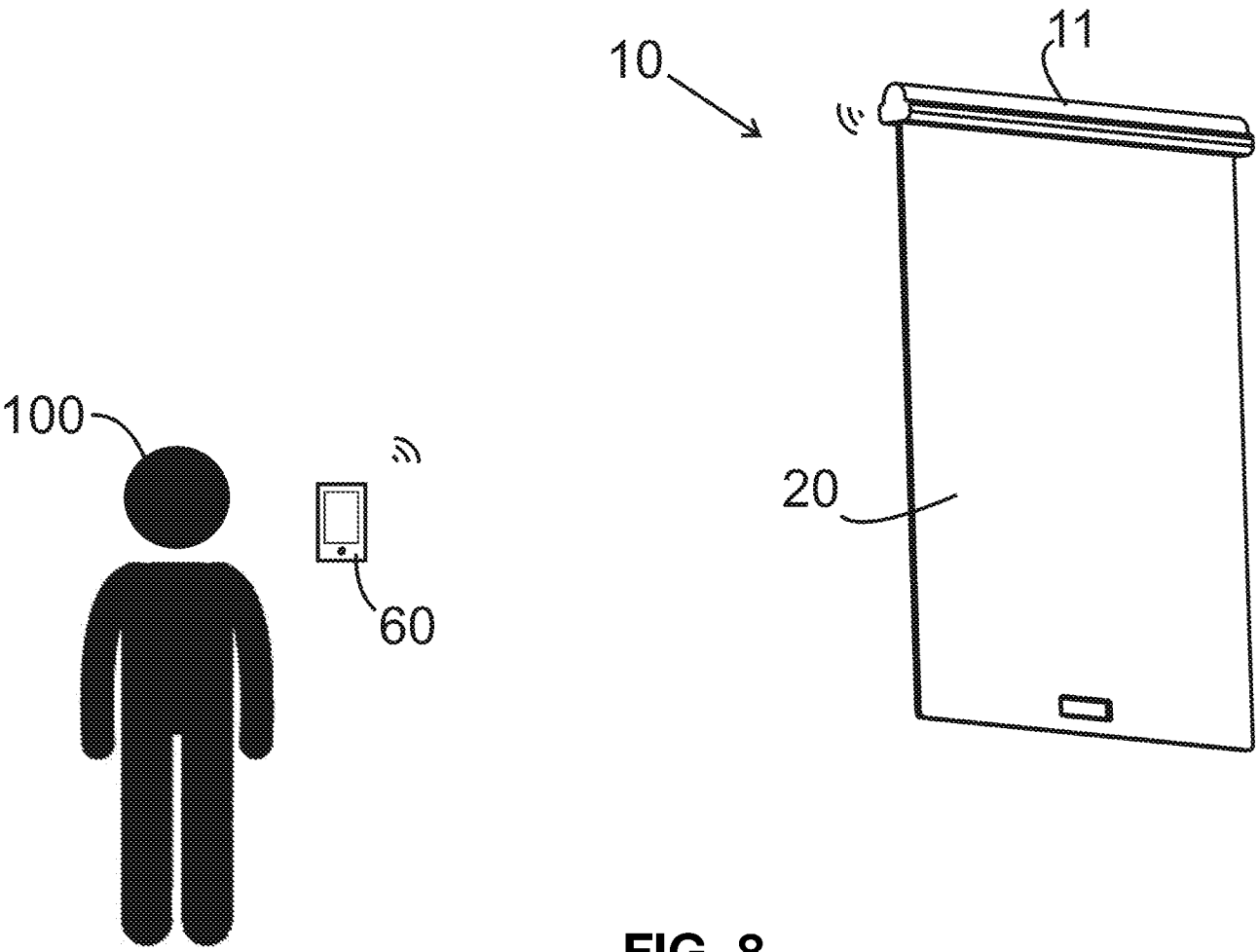
FIG. 8 shows a schematic view of the first embodiment of the present invention.

As shown in FIG. 8, the caution sign 20 of the present invention can be retracted by the mobile phone 60 or by the computer network through a user 100. One of the examples is a wet sign, which has the electro-mechanical timer, so the user can retract the caution sign by a mobile application or even set a notification for others to retract the sign in a specific time.

Figure 9:
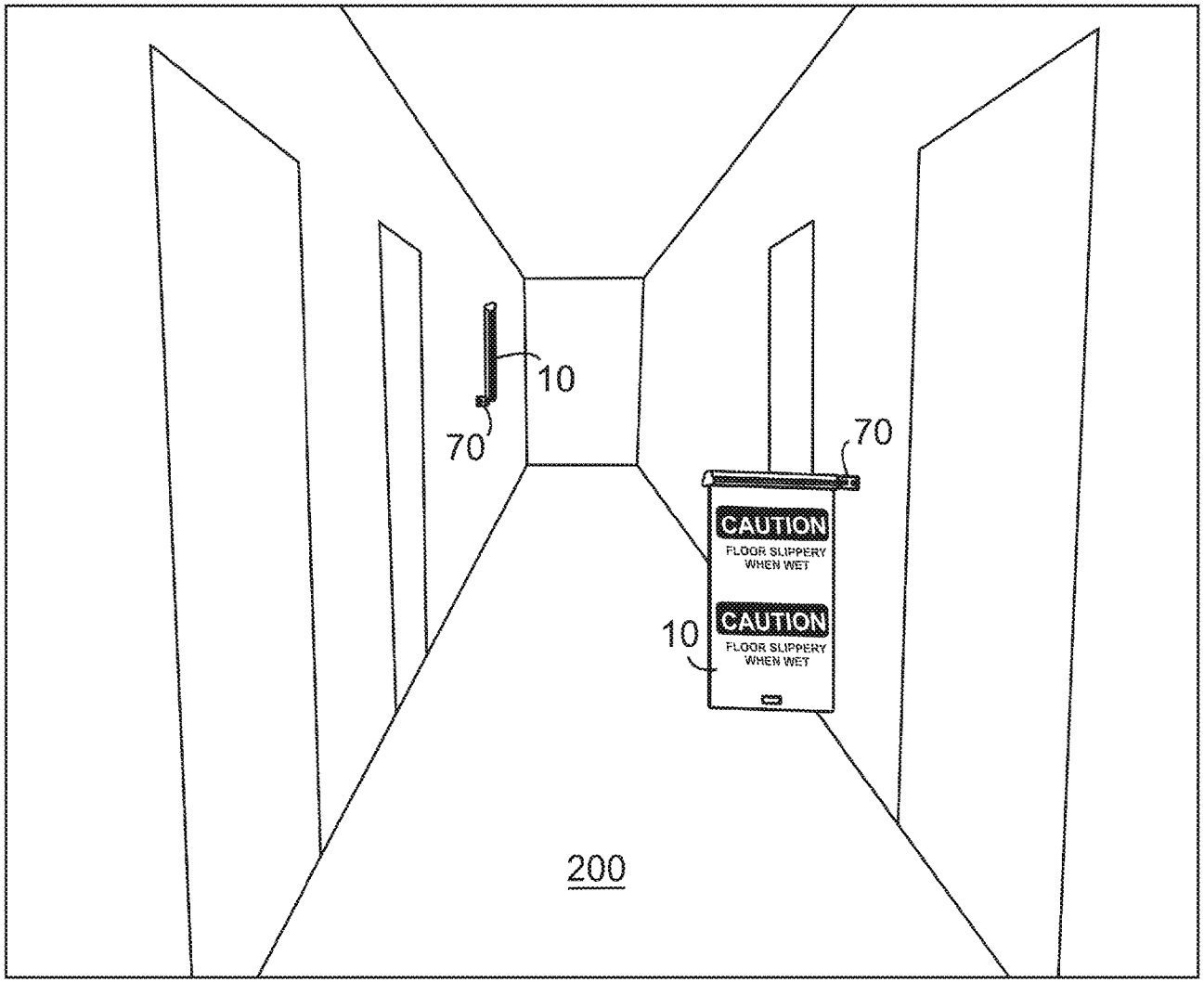
FIG. 9 shows a schematic view of the second embodiment of the present invention in a hallway.

FIG. 9 shows a wet sign 10 based on the second embodiment of the present invention. A person which is responsible for the cleaning of the hallway 200 pulls out the wet sign 10, which hangs on the hallway 200. The wet sign 10 has a built-in mechanical timer in the housing, which after a pre-set period of time (for example one hour) it will roll in inside the housing and also the whole wet sign 10 retracts from horizontal position to the vertical position to the wall by a hinge 70. The hinge 70 is attached to the distal end of the housing.

Again as shown in FIG. 9, there are two wet signs 10. One of the signs is pulled out and it is set to a pre-set period of time and the other one is pulled in and retracted after the pre-set period of time.

The design and mechanism of the whole system in the second embodiment of the present invention is similar to the first embodiment. The only difference is the retraction after the pre-set period of time. In the second embodiment, the sign is automatically lifted up once it is not needed. This allows the sign to be placed at even lower levels on the walls. The first embodiment has to be places at higher levels to that it does not obstruct the movement of the people and objects. Again this sign can be mounted at strategic location to be used as needed.

Figure 10B:
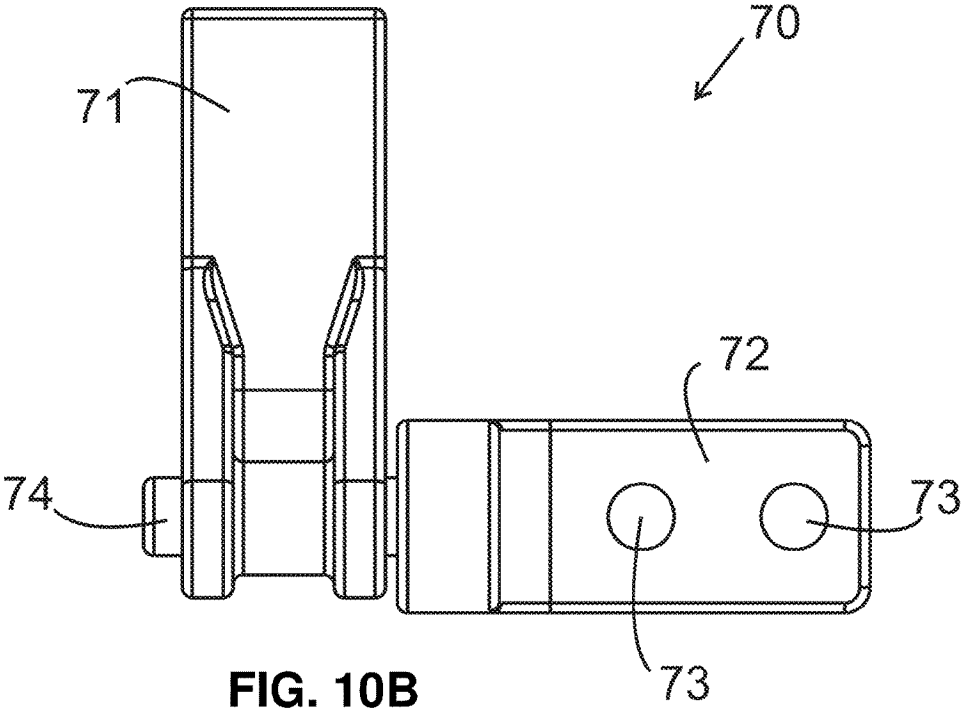
FIG. 10B shows a front view of the hinge assembly of the present invention.
Figure 10A:
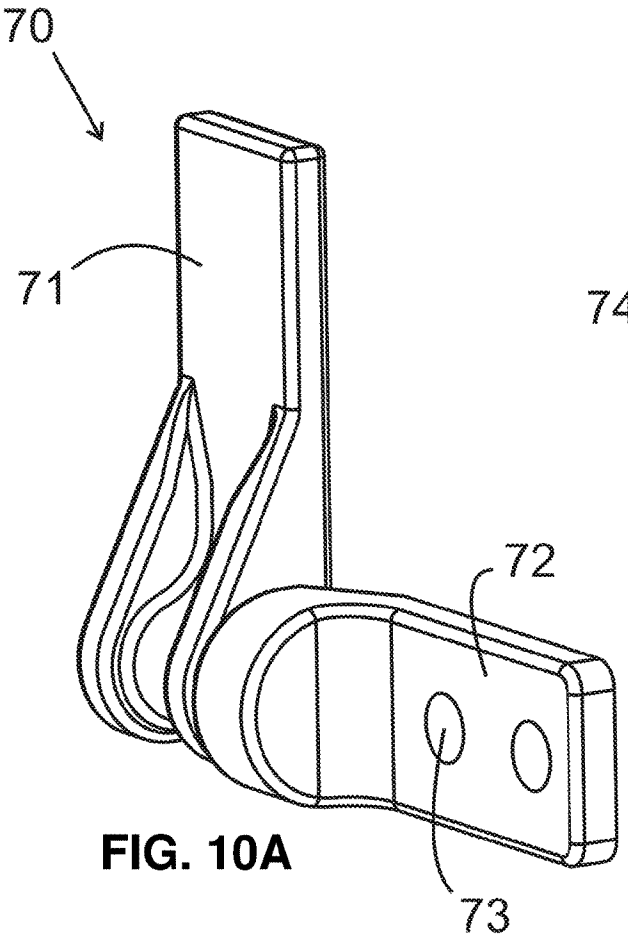
FIG. 10A shows a perspective view of the hinge assembly of the present invention.

FIGS. 10A and 10B shows a hinge assembly 70 in the present invention. The hinge assembly 70 connects the housing of the sign to a wall. The hinge assembly 70 allows 90 degrees angle of rotation between the housing and the wall. The housing of the sign is coupled to the first leaf 71 of the hinge assembly 70 and the wall is attached to the second leaf 72 of the hinge assembly 70. The second leaf 72 has connection means 73 to connect to the wall or a surface.

In one embodiment, the hinge of the present invention comprises of a compressed coil spring disposed inside a pivoting point 74 of the hinge assembly 70. The compressed coil spring is placed at a centre of a pin the pivoting point 74. The movement of the first leaf 71 is regulated by the compressed coil spring.

The hinge in the present invention can provide the rotational movement for the housing of the sign. In a normal condition, the leaves 71, 72 of the hinge assembly 70 are located perpendicular to each other. The first leaf 71 can be rotated around the pivoting point 74 and stay in a parallel position relative to the ground by a catch pin inside the hinge. The user can release the catch pin to able the first leaf 71 come back to the normal position.

Figure 11A:
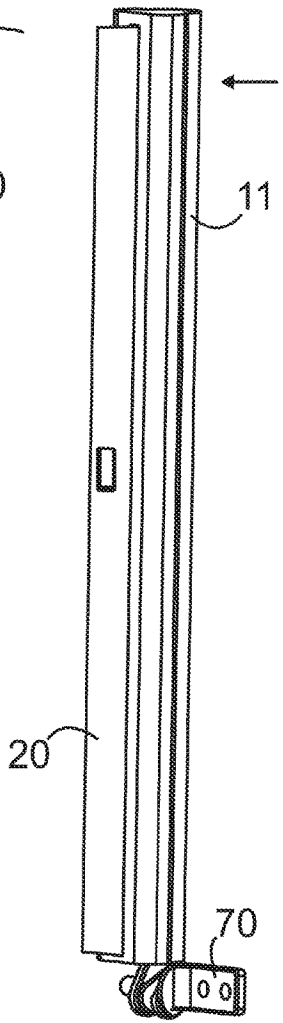
FIG. 11A shows a perspective view of the second embodiment of the present invention.
Figure 11B:
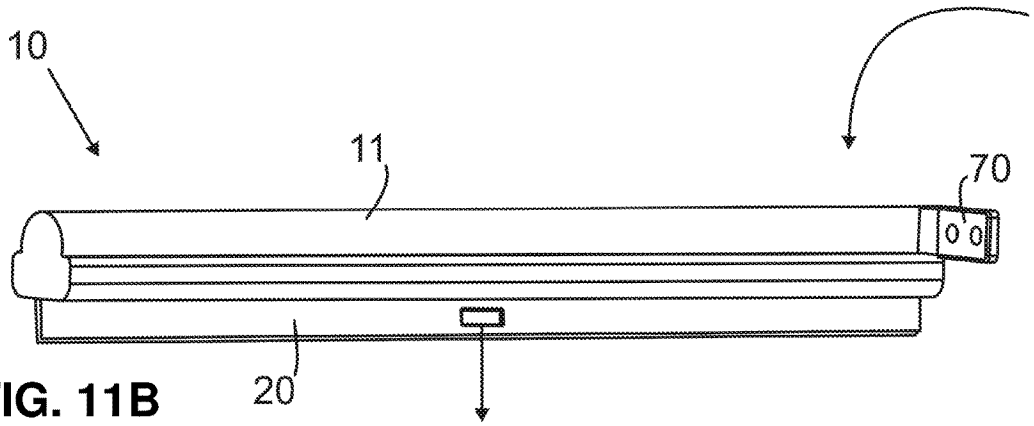
FIG. 11B shows a perspective view of the second embodiment of the present invention.
Figure 11C:
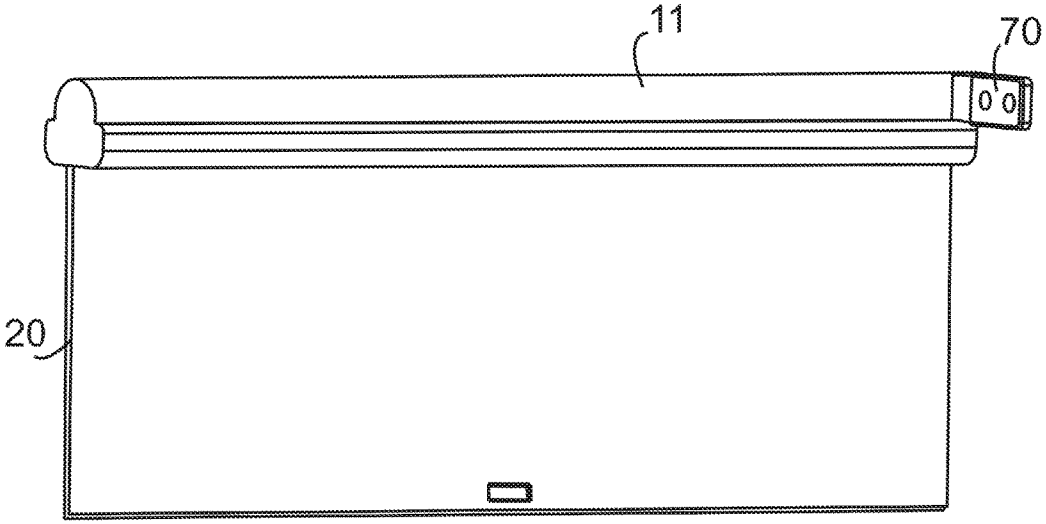
FIG. 11C shows a perspective view of the second embodiment of the present invention.
Figures 12A, 12B, 12C:
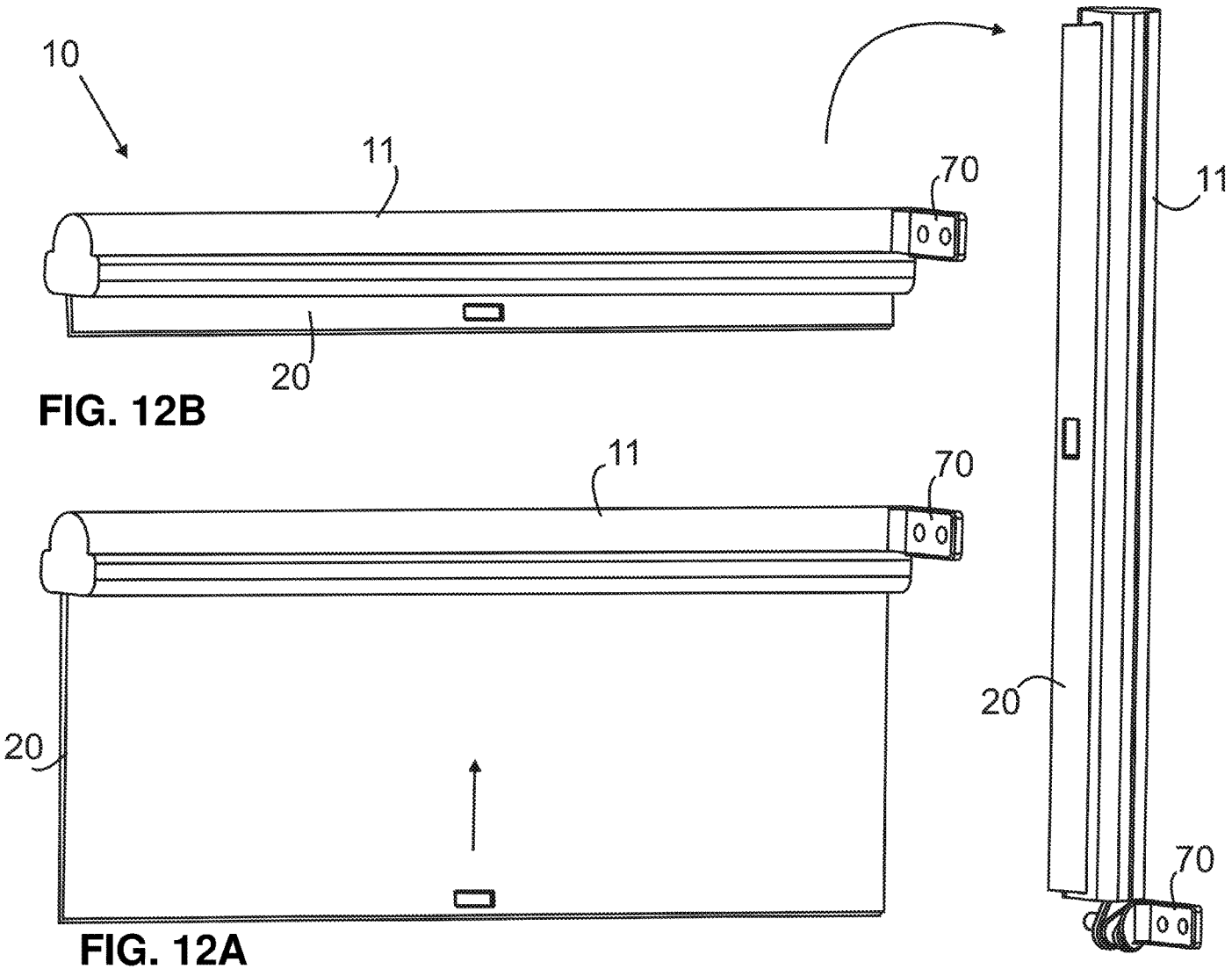
FIG. 12A shows a perspective view of the second embodiment of the present invention.
FIG. 12B shows a perspective view of the second embodiment of the present invention.
FIG. 12C shows a perspective view of the second embodiment of the present invention.

FIGS. 11A, 11B, 11C, 12A, 12B and 12C show the second embodiment of the present invention in three different positions. FIG. 11A shows the second embodiment of the present invention, which is attached to a wall and is in parallel position relative to the wall. A user can push the housing 11 to be perpendicular to the wall (FIG. 11B) and then pull out the elongated strap 20 (FIG. 11C). By pulling out the elongated strap 20, the mechanical timer is activated and after a period of time, the elongated strap 20 retracts inside the housing 11, as shown in FIGS. 12A and 12B. The catch pin in the hinge assembly 70 in the present invention is then releases and the sign 10 returns back to the parallel position relative to the wall (FIG. 12C).

In the second embodiment of the present invention, the mechanical timer can be replaced with an electro-mechanical timer and also the hinge assembly 70 can be operated by an electric trigger to trigger the catch pin in the hinge 70. By having the electric trigger in the hinge assembly 70, the operation of the hinge can be controlled by a mobile application or a computer.

Figure 13:
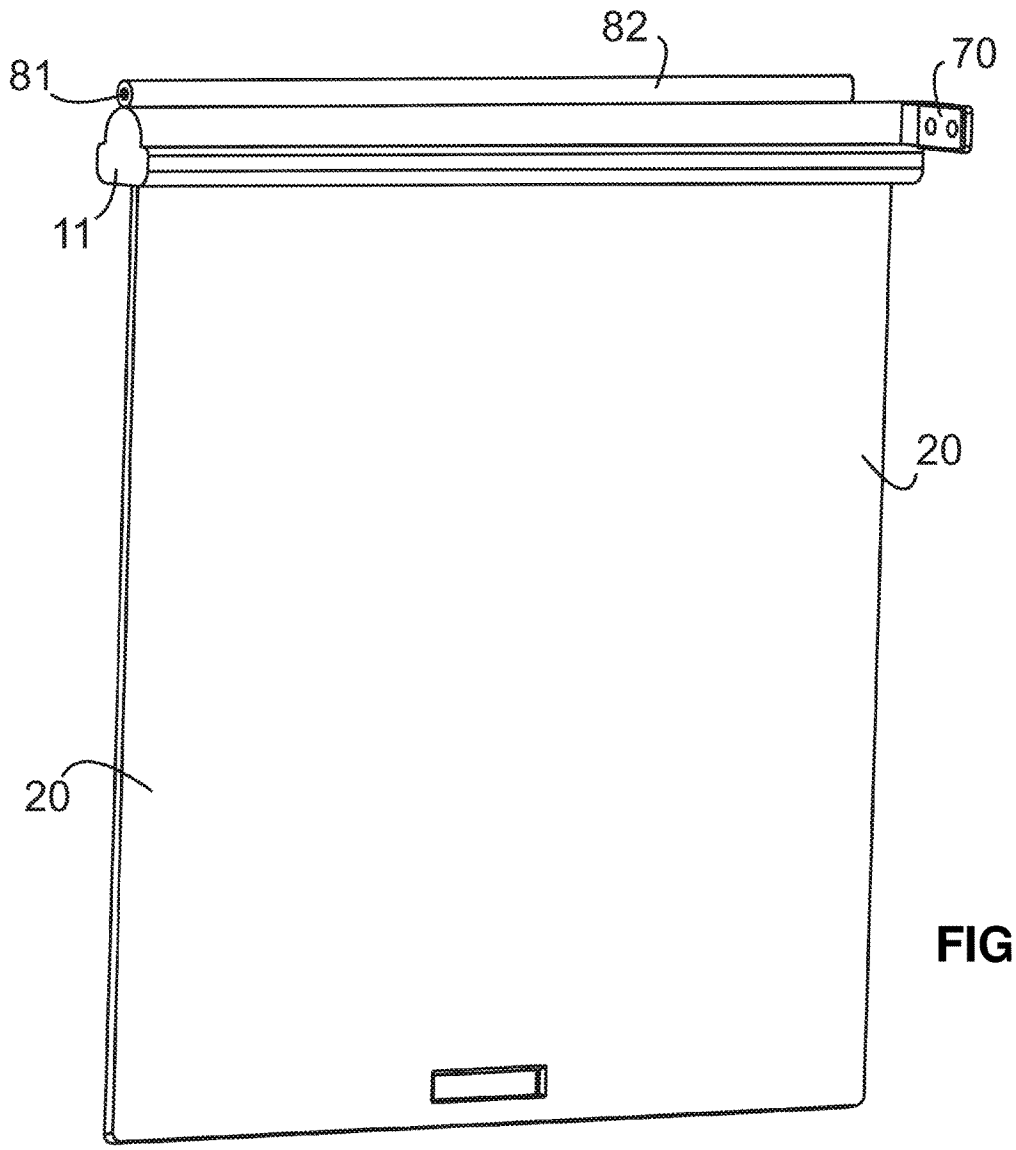
FIG. 13 shows a perspective view of the second embodiment of the present invention.

FIG. 13 shows the second embodiment of the present invention, which further comprises of an extendable warning rod 81 housed inside a circular housing 82 attached to the top part of the housing 11. In the case a user wishes to block a pathway, and if the sign is not wide to block the whole pathway, the extendable warning rod 81, as shown in FIG. 14, can be pulled out to block the pathway.

The extendable warning rod 81 returns to the circular housing 82 by the force of gravity. The extendable warning rod 81 and the circular housing 82 are designed in such a way that by returning the housing 11 of the caution sign from the horizontal position to the vertical position, the rod retracts into the circular housing 82.

Figure 14:
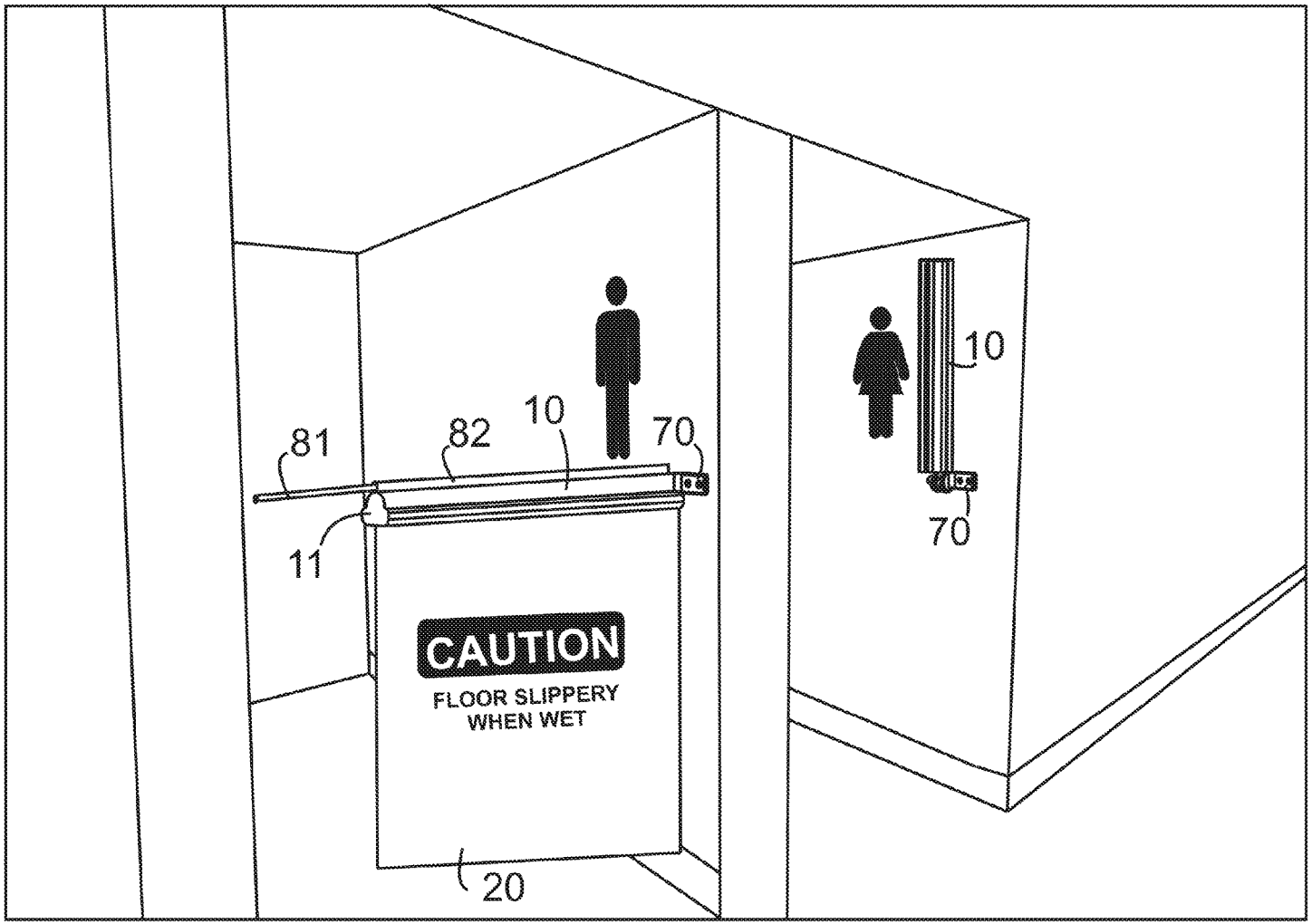
FIG. 14 shows a schematic view of the second embodiment of the present invention in a washroom.

FIG. 14 shows an example of the wet caution sign 10 based on the second embodiment of the present invention. The wet caution sign 10 is retracted and also the elongated warning rod 81 is pulled out from the circular housing.

In first and second embodiment of the present invention when the timer is electro-mechanical timer, a user can set the time for the caution sign and monitor the remaining time of the sign by a mobile phone application or a computer software and also notify other parties about the status of the signs at any time.

In another embodiment of the present invention, the timer and the spring assembly is replaced with an electric motor inside the housing to pull out/in of the elongated strap. The electric motor can be programmed to operate with a mobile phone or a computer at a specific time. The user of the caution sign with an electric motor of the present invention can display one or more sign at a same time and retract them after a period of time.

In another embodiment of the present invention, a stopper can be designed in the first embodiment and/or the second embodiment of the present invention to stop the mechanical timer and/or electro-mechanical timer operation. In this scenario, the user can activate the stopper at any time during the display time of the sign.

The present invention can be affix to a wall or a ceiling with any well-known attachment mechanism. The attachment is in a way to maximize the visibility and appearance of the sign when it is displayed. One example for attachment of the present invention to a metal ceiling can be a magnetic part which placed inside the housing. The location and the shape of the magnetic part can be vary based on the size and shape of the present invention.

The foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A retractable warning sign having a timer, comprising:

a) an elongated housing having a longitudinal slot, a distal end, and a proximal end;

b) a retractable strap wound around a spool assembly and housed inside said elongated housing that extends and retracts through said longitudinal slot;

c) a timer connected to said spool assembly to set a retraction time for said retractable strap, and wherein a length of said retractable strap depends to said retraction time;

d) a hinge assembly coupled to said proximal end of said elongated housing to provide a translational movement for said elongated housing, and e) an attachment mechanism to attach said elongated housing on a wall or a ceiling or a window.

2. The retractable warning sign of claim 1, wherein said timer is an electro-mechanical timer which sets the time for said retractable warning sign and monitors the remaining time by a mobile phone or a computer and notifies other parties about the completion of a job.

3. The retractable warning sign of claim 2, wherein said electro-mechanical timer is a cam timer.

4. The retractable warning sign of claim 1, further having an extendable warning rod, wherein said warning rod is extendably attached to said elongated housing and is extended longitudinally outward to further restricts a local traffic.

5. The retractable warning sign of claim 4, wherein said extendable warning rod is designed to be extended manually and it retracts by the force of gravity when the elongated housing is lifted upwardly to a vertical position.

6. The retractable warning sign, comprising:

a) an elongated housing having a longitudinal slot, a distal end, and a proximal end;

b) a retractable strap wound around a spool assembly and housed inside said elongated housing that extends and retracts through said longitudinal slot;

c) a hinge assembly coupled to said elongated housing to provide a translational movement for said elongated housing;

d) an attachment mechanism to attach said elongated housing on a wall or a ceiling or a window;

e) an electric motor to retract said retractable strap and fold said hinge, and wherein said electric motor sets the time for said retractable warning sign and monitors the remaining time by a mobile phone or a computer and notifies other parties about the completion of a job, and f) a computer program to trigger a releasing point for said electric motor to retract said elongated strap into said housing after a predefined period of time.

* * * * *